United States Patent [19]

Kodama et al.

[11] Patent Number: 4,616,607

[45] Date of Patent: Oct. 14, 1986

[54] VALVE DRIVING DEVICE FOR INTERNAL COMBUSTION ENGINE

[75] Inventors: Hisashi Kodama, Nagoya; Takuro Ono, Chiryu, both of Japan

[73] Assignee: Aisin Seiki Kabushiki Kaisha, Kariya, Japan

[21] Appl. No.: 697,163

[22] Filed: Feb. 1, 1985

[30] Foreign Application Priority Data

Mar. 22, 1984 [JP] Japan ..... 59-55659

[51] Int. Cl.[4] ..... F01L 1/18

[52] U.S. Cl. ..... 123/90.46; 123/90.36; 123/90.57

[58] Field of Search ..... 123/90.55, 90.36, 90.27, 123/90.57, 90.46

[56] References Cited

U.S. PATENT DOCUMENTS

| | | | |
|---|---|---|---|
| 1,784,767 | 12/1930 | Summers | 123/90.57 |
| 2,749,888 | 6/1956 | Roos | 123/90.36 |
| 3,008,544 | 11/1961 | Kritzman | 123/90.36 |
| 4,192,263 | 3/1980 | Kitagawa et al. | 123/90.36 |
| 4,497,307 | 2/1985 | Paar et al. | 123/90.36 |
| 4,505,236 | 3/1985 | Nakamura | 123/90.27 |
| 4,523,551 | 6/1985 | Arai et al. | 123/90.36 |

FOREIGN PATENT DOCUMENTS

| | | | |
|---|---|---|---|
| 538952 | 8/1941 | United Kingdom | 123/90.57 |

*Primary Examiner*—Ira S. Lazarus

*Attorney, Agent, or Firm*—Oblon, Fisher, Spivak, McClelland & Maier

[57] ABSTRACT

A valve driving device for an internal combustion engine including a hydraulic lifter in each rocker arm and a rocker shaft swingably supporting the rocker arms wherein a first oil passage is provided through the internal bore of the rocker shaft for supplying oil to a reservoir of the hydraulic lifter. A second oil passage is formed through a rocker support for supplying oil in the first oil passage, and an air exhaust port is provided for exhausting air intruded into the internal bore of the rocker shaft to outside.

6 Claims, 5 Drawing Figures

VALVE DRIVING DEVICE FOR INTERNAL COMBUSTION ENGINE

BACKGROUND OF THE INVENTION

1. Field of the Invention

This invention relates to a valve driving device for an internal combustion engine, and more particularly to a type thereof including a hydraulic lifter in each of the rocker arms.

2. Discussion of the Background

In an ordinary internal combustion engine, it has been required to provide a valve clearance of a predetermined length for eliminating adverse effects caused by differences between the thermal expansions of the cylinder head, cylinder block and the like and those of the valve driving mechanism. In the situation where the clearance is not maintained correctly, noises and/or output loss due to the leakage of crude gas tend to occur during the operation. For preventing such a drawback, a hydraulic lifter has been proposed which maintains the valve clearance at zero during the operation of the valve driving mechanism while eliminating the noise and the output loss and stabilizing the operation of the mechanism. The present invention relates to a valve driving device for an automobile engine in which the hydraulic lifters are utilized.

Japanese Patent Disclosure No. 16,113/1978 discloses such a valve driving device for an internal combustion engine including hydraulic lifters. In this device, each hydraulic lifter is encased in a rocker arm, one end thereof receiving a load from a cam shaft while the other end thereof driving a valve stem. Each hydraulic lifter comprises a plunger slidably encased in the rocker arm so that one end of the plunger operates the valve stem, while the other end thereof forms a pressurized chamber, a reservoir formed in the body of the rocker arm, and a check valve which permits flow of a pressurized oil only in a direction from the reservoir to the pressurized chamber. An oil passage is further provided through a rocker shaft swingably supporting the rocker arm, so that an operative oil such as engine oil supplied from an oil pump is sent through the oil passage into the reservoir of the hydraulic lifter.

With the above described valve driving device, however, a large amount of bubbles tend to be mixed in the operative oil supplied into the reservoir through the oil passage formed in the rocker shaft at the time of engine start or abruptly increasing or decreasing the rotating speed of the engine. The bubbles are collected in an upper part of the reservoir, and when the amount thereof becomes excessive, the bubbles intrude into the pressurized chamber, losing the rigidity of the hydraulic lifter and entailing creation of impacting sound between the plunger and its stopper or between the valve and the valve seat.

SUMMARY OF THE INVENTION

An object of the present invention is to provide a valve driving device for an internal combustion engine having a hydraulic lifter in each of the rocker arms, wherein bubbles tending to be mixed in the operational oil are exhausted outside, and the intrusion of the bubbles into the pressurized chamber is thereby prevented.

The above described and other objects of the invention can be achieved by a valve driving device for an internal combustion engine, of a type comprising a hyraulic lifter encased in each rocker arm that receives a driving force at one end thereof and operates a valve stem by the other end thereof, and a rocker shaft swingably supporting the rocker arms, the device comprising a first oil passage formed through an internal bore of the rocker shaft for supplying an operational oil to a reservoir formed in the hydraulic lifter, a second oil passage which is formed through a rocker support supporting the rocker shaft for supplying the oil into the first oil passage, and an air exhaust port which exhausts air intruded in an upper part of the internal bore of the rocker shaft to outside.

According to the present invention, since an air exhaust port is provided in an upper part of the internal bore of the rocker shaft, provision of an air exhaust port for each hydraulic lift can be avoided even in a case where a plurality of hydraulic lifters are provided in connection with the rocker shaft.

Furthermore, an oil filter may be provided in the second oil passage so as to prevent intrusion of strange particles into the hydraulic lifter. Since the quantity of oil used for the hydraulic lifter and the lubrication of the rocker arms is relatively small, an oil filter of a fine mesh size placed in the second oil passage does not impose much resistance to the flow of oil.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

The invention will now be described with reference to the accompanying drawings.

Figure 1:
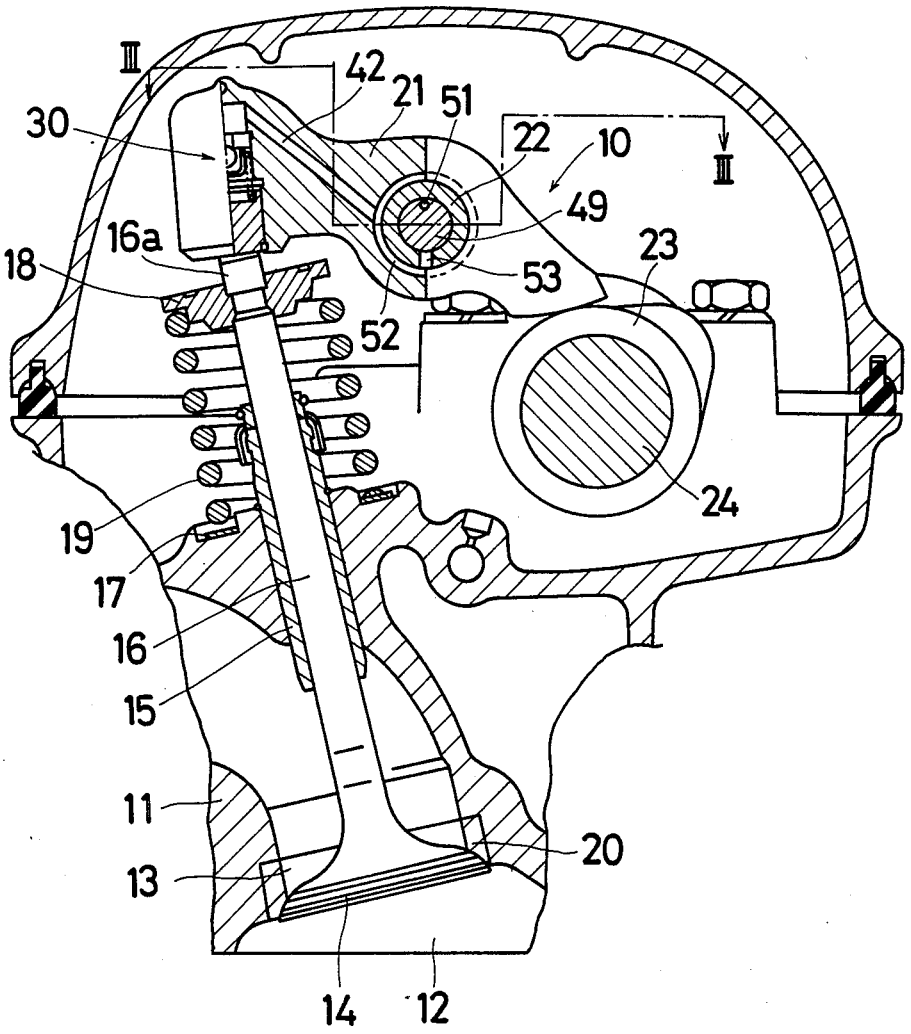
FIG. 1 is a sectional view showing a valve driving device for an internal combustion engine, which constitutes a preferred embodiment of the present invention.

FIG. 1 illustrates a valve driving device 10 for an internal combustion engine of a over-head cam type. A cylinder head 11 provided upward of the engine defines a combustion chamber 12 therein, which communicates with other portion through a cylinder head port 13. An engine valve 14 is provided to control opening and closing of the cylinder head port 13. A valve guide 15 secured to the cylinder head 11 slidably supports a valve stem 16. A valve spring 19 is provided between a spring seat 17 formed on a portion of the cylinder head 11 and a spring retainer 18 secured to the upper end of the valve stem 16. The valve spring 19 constantly urges the valve 14 upwardly toward a valve seat 20.

A rocker arm 21 is mounted on a rocker arm shaft 22 to be swingable therearound. One end of the rocker arm 21 receives a driving force from a cam 23, while the other end of the rocker arm 21 is operatively coupled with the valve stem 16 through a hydraulic lifter 30. The cam 23 is rotated together with the cam shaft 24 coupled with a crank shaft (not shown) of the engine. The rotation of the cam shaft 24 operates the valve 14 through the rocker arm 21 and the hydraulic lifter 30.

Figure 2:
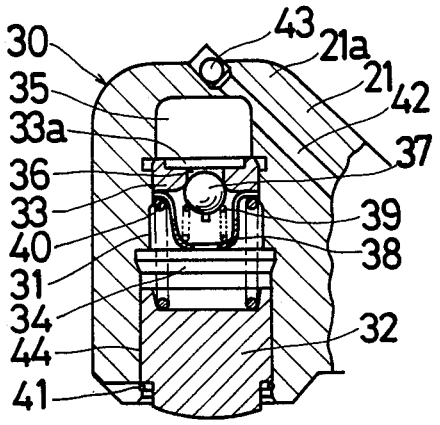
FIG. 2 is an enlarged sectional view showing a hydraulic lifter used in the valve driving device of FIG. 1.

The construction of the hydraulic lifter 30 will now be described with reference to FIG. 2. A cylinder portion 31 is formed within the main body 21*a* of the rocker arm 21. The cylinder portion 31 opens downwardly. A plunger 32 is inserted so as to be slidingly movable in the cylinder portion 31. The lower end of the plunger 32 is formed into a spherical surface to be contactable with the upper end 16*a* of the valve stem 16 advantageously. The plunger 32 is formed of a simple configuration of a solid cylinder so that a roller of a ordinary roller bearing may be used as the plunger.

A valve seat member 33 is forced into the cylinder portion 31 to be secured to an upper portion thereof. The valve seat member 33 divides the interior of the cylinder portion 31 into a reservoir 35 provided upwardly and a pressurized chamber 34 provided downwardly. For the purpose of reducing cost, the reservoir 35 is machined from the lower side of the cylinder portion 31. The valve seat member 33 is made of a wear-resistant material, and formed with a central hole 36 that communicates the pressurized chamber 34 with the reservoir 35. A stepped portion 33*a* is provided in the valve seat member 33 for increasing the capacity of the reservoir 35 and for the convenience of assembly.

On a side of the valve seat member 33 facing the pressurized chamber 34 is provided a ball check valve 37. The ball check valve 37 is supported by a spring 39, one end of which is supported by a retainer member 38. The spring 39 urges the ball check valve 37 upwardly toward a seat formed on the valve seat member 33. In this manner the ball check valve 37 permits the flow of an operative fluid such as engine oil from the reservoir 35 to the pressurized chamber 34 only. In the pressurized chamber 34 is provided a plunger spring 40 one end of which is supported by a retainer 38. The plunger 32 is urged by the other end of the spring 40 downwardly to be brought into contact with the valve stem 16. The downward movement of the plunger 32 is restricted by a snap spring 41 secured to the lower end of the cylinder portion 31.

An oil supplying passage 42 is formed through the main body 21*a* of the rocker arm 21. Through the oil supplying passage 42, an operative oil such as engine oil is forcibly supplied from an oil supplying source such as an oil pump (not shown) to the reservoir 35. The oil passage 42 opens in the reservoir 35 at an upper part thereof. Thus the flow of the oil out of the reservoir 35 is restricted even in the case of the engine stopping, and a sufficient amount of the operative oil is maintained in the reservoir 35. The oil supplying passage 42 is machined from an upper part of the rocker arm 21 toward the rocker arm shaft 22, and after the machining of the passage 42, the upper end of the passage 42 is closed by means of a blind plug 43.

Figure 3:
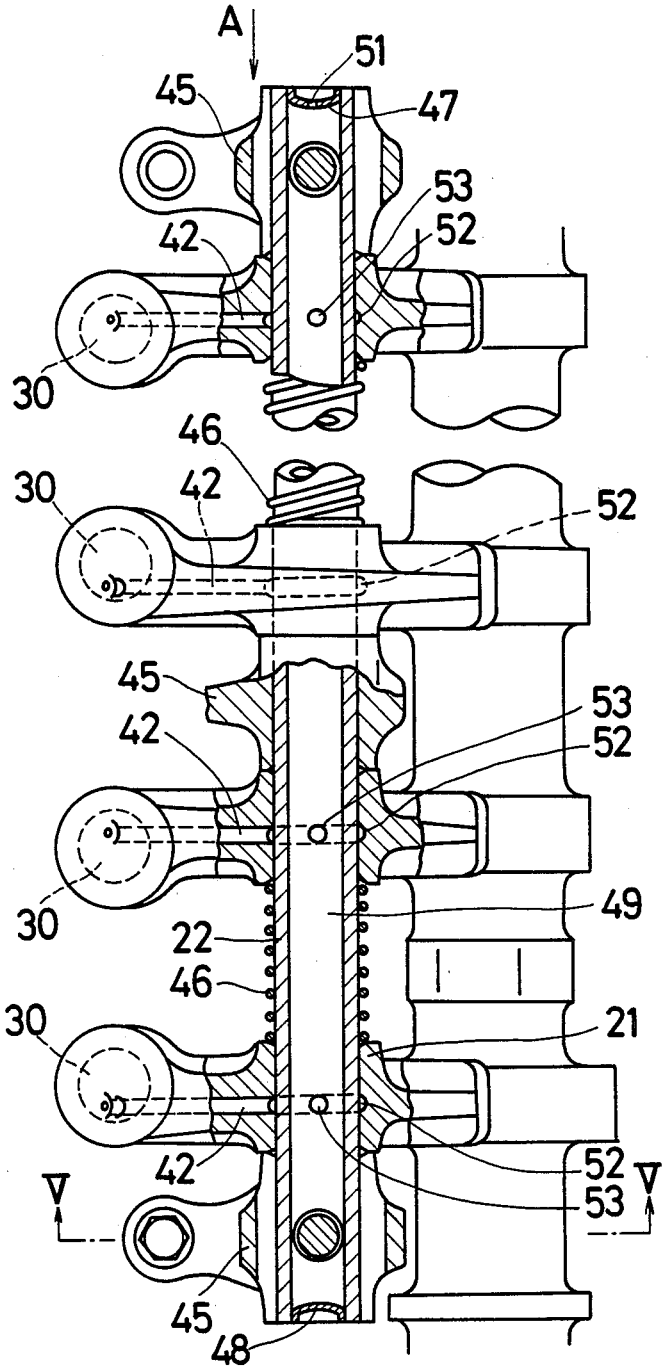
FIG. 3 is a partly fragmented sectional view taken along the line III—III in FIG. 1.

As is apparent from FIG. 3, the rocker arm shaft 22 is fixedly supported by a plurality of rocker supports 45, and a plurality of rocker arms 21 are swingably supported by the rocker arm shaft 22. Within the rocker arms 21, the hydraulic lifters 30 are encased, respectively. Between each pair of adjacent rocker arms 21 is provided a spring 46. The spring 46 urges the rocker arms provided on both sides of the spring 46 outwardly toward positions defined by the rocker supports 45. The hydraulic lifter 30 encased in one of the rocker arms thus positioned is used for operating suction side valve stem 16, while the hydraulic lifter 30 encased in the other of the rocker arms thus positioned is used for operating exhaust side valve stem 16.

The oil supplying passages 42 formed through the rocker arms 21 to extend into the reservoirs 35 of the hydraulic lifters 30 are connected to a first oil supplying passage 49 formed through the internal bore of the rocker arm shaft 22. Both ends of the first oil supplying passage 49 are closed by blind plugs 47 and 48, respectively.

Figure 5:
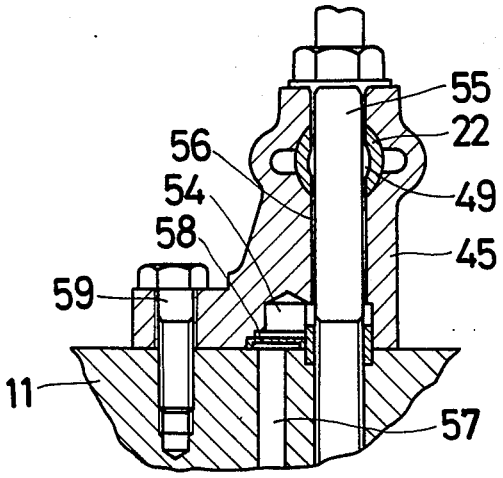
FIG. 5 is a sectional view along the line V—V in FIG. 3.

On the other hand, a second oil supplying passage 54 formed through the rocker support 45 as shown in FIG. 5 is connected to the first oil supplying passage 49 through a gap passage 56 formed between the rocker support 45 and a screw-threaded member 55. The second oil supplying passage 54 is inwardly connected to an oil supplying source such as an oil pump (not shown) through another oil passage 57 formed through the cylinder head 11.

Figure 4:
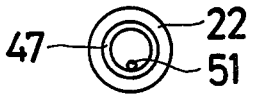
FIG. 4 is an end view taken in the direction A in FIG. 3.

In the embodiment shown in FIG. 3, an air exhaust port 51 is formed through the blind plug 47. As described hereinbefore, a large amount of bubbles tend to be mixed into the operative oil at the time of engine start or when the rotating speed of the engine is abruptly increased or decreased. Most part of the bubbles, however, can be exhausted outside through the air exhaust port 51 provided through the blind plug 47, and the possibility of the bubbles intruding into the pressurized chambers 34 of the hydraulic lifters 30 can be substantially eliminated. As is apparent from FIGS. 1 and 4, the air exhaust port 51 is provided in upper part of the blind plug 47 communicating with an upper portion of the internal bore of the rocker shaft 22. On the other hand, the oil passage 42 formed through the rocker arm 21 is connected to the first oil supplying passage 49 through an annular groove 52 formed around the rocker shaft 22 and a through hole 53 provided through the shaft at a lower position opposite to the upper position in which the air exhaust port 51 is provided. As a consequence, most of the bubbles mixed into the operative oil while the oil flows from the oil supplying source to the second oil supplying passage 54 are collected in an upper part of the first oil supplying passage 49, and then are exhausted through the air port 51 to outside.

Furthermore, since the oil filter 58 is provided at a position where the second oil supplying passage 54 is connected to the oil passage 57 formed through the cylinder head 11, as shown in FIG. 5, any strange matter tending to be mixed in the oil can be removed out of the oil. The oil filter 58 may be made of a metal wire net, punched metal or a sintered material of a mesh size smaller than the diameter of the air exhaust port 51. Because of the provision of the oil filter 58, any possibility of the air exhaust port 51 being blocked by the strange matter can be eliminated. The above described screw-threaded member 59 is provided for securing the rocker support 45 to the cylinder head.

The operation of the valve driving device according to the present invention will now be described.

When the engine is started after oil has been supplied from the oil supplying source to the reservoir 35, the cam shaft 24 is rotated, so that the plunger 32 of the hydraulic lifter 30 is forced downward as viewed in FIG. 1 together with the rocker arm 21. The plunger 32 is thus moved inwardly by a distance $\alpha$ while increasing the pressure of the pressurized chamber 34. The increased pressure shifts the check valve 37 so as to close the central hole 36 of the valve seat member 33. At this time, oil in the pressurized chamber 34 tends to leak through a clearance 44 between the internal surface of the cylinder portion 31 and the plunger 32 to outside. When the cam shaft 24 is further rotated, the plunger 32 is pushed out of the cylinder portion 31 by the force of the plunger return spring 40 through the distance $\alpha$. As a result, the pressure in the pressurized chamber 34 is reduced, and the check valve 37 opens the central hole 36 of the valve seat member 33. Thus the oil stored in the reservoir 35 flows into the pressurized chamber 34 for replenish the leaked oil. The plunger 32 repeats the above described advance and retract of the distance $\alpha$ during the operation of the internal combustion engine.

In case where thermal deformation of the crank shaft or cylinder of the engine produces a clearance in the valve driving device, the plunger return spring 40 pushes the plunger 32 out of the cylinder portion 31. Conversely, when the valve driving device is elongated by a distance $\beta$, the plunger 32 of the hydraulic lifter 30 is pushed out only a reduced distance $l=\alpha-\beta$ by the force of the spring 40. As a consequence, smooth operation under zero-lash condition of the valve driving device is maintained regardless of thermal deformation of the crank shaft or else.

Although in the above described embodiment, the air exhaust port has been provided only through the blind plug 47, it is of course possible to provide another air exhaust port through the other blind plug 48.

Furthermore, although the hydraulic lifter has been combined in the rocker arm on the side facing the valve stem, the hydraulic lifter may otherwise be combined in the rocker arm on the side facing the cam shaft as disclosed in the Japanese Patent Disclosure No. 16,113/1978.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A valve driving device for an internal combustion engine, of a type which includes a hydraulic lifter encased in each rocker arm for receiving a driving force at a first end thereof and for operating a valve stem at a second end thereof, and a rocker shaft swingably supporting the rocker arm, the device, comprising:

first oil passage means formed through an internal bore of the rocker shaft for supplying an operational oil to a reservoir formed in said hydraulic lifter;

second oil passage means formed through a rocker support supporting said rocker shaft for supplying the oil into said first oil passage;

air exhaust port means for exhausting air located in an upper part of said internal bore of said rocker shaft to outside;

an oil filter provided in said second oil passage means for removing impurities from said oil; and third oil passage means formed through said rocker air for interconnecting said reservoir and said first oil passage wherein said third passage means opens into said reservoir at an upper part thereof and wherein a connection between said first oil passage means and said third oil passage means further comprises an annular passage formed around said rocker shaft and fourth passage means formed through said rocker shaft.

2. A valve driving device as set forth in claim 1 further comprising first and second fluid plugs wherein opposite ends of said first oil passage are closed by said first and second blind plugs, respectively, and wherein said air exhaust port means is formed through either one of said blind plugs.

3. A valve driving device as set forth in claim 1 wherein said fourth passage means formed through said rocker shaft is provided at a lower position opposite that of said air exhaust port means.

4. A valve driving device as set forth in claim 1 and wherein said oil filter further comprises a metal wire net and wherein said oil filter has a mesh size smaller than a diameter of said air exhaust port means.

5. A valve driving device as set forth in claim 1, wherein said oil filter further comprises punched metal and wherein said oil filter has a mesh size smaller than the diameter of said air exhaust port means.

6. A valve driving device as set forth in claim 1, wherein said oil filter further comprises a sintered material wherein said oil filter has a mesh size smaller than the diameter of said air exhaust port means.

* * * * *

UNITED STATES PATENT AND TRADEMARK OFFICE

CERTIFICATE OF CORRECTION

PATENT NO. : 4,616,607

DATED : OCTOBER 14, 1986

INVENTOR(S) : HISASHI KODAMA and TAKURO ONO

It is certified that error appears in the above-identified patent and that said Letters Patent is hereby corrected as shown below:

In column 2, line 51, delete "a over-head" and insert --an overhead--;

In column 3, line 13, delete "a ordinary" and insert --an ordinary--;

In column 5, line 11, delete "for" and insert --to--;

In column 6, line 16, delete "air" and insert --arm--.

Signed and Sealed this

Eighth Day of December, 1987

*Attest:*

DONALD J. QUIGG

*Attesting Officer*

*Commissioner of Patents and Trademarks*